US005793286A

United States Patent [19]

Greene

[11] Patent Number: 5,793,286

[45] Date of Patent: Aug. 11, 1998

[54] COMBINED INFRASONIC AND INFRARED INTRUSION DETECTION SYSTEM

[75] Inventor: Robert Charles Greene, Miami, Fla.

[73] Assignee: Seaboard Systems, Inc., Miami, Fla.

[21] Appl. No.: 591,961

[22] Filed: Jan. 29, 1996

[51] Int. Cl.[6] ..... G08B 13/22

[52] U.S. Cl. ..... 340/522; 340/539; 340/554; 340/566; 340/567

[58] Field of Search ..... 340/522, 566, 340/567, 554, 539

[56] References Cited

U.S. PATENT DOCUMENTS

| | | | |
|---|---|---|---|
| 4,195,286 | 3/1980 | Galvin | 340/522 |
| 4,684,929 | 8/1987 | Edwards et al. | 340/522 |
| 5,319,698 | 6/1994 | Glidewell et al. | 340/539 |

*Primary Examiner*—Olen Swann

*Attorney, Agent, or Firm*—Herbert L. Lerner; Laurence A. Greenberg

[57] ABSTRACT

An intrusion and alarm sending arrangement having at least one motion sensing device and a first motion signal threshold device has an input connected to said motion sensing device for generating a motion alarm indication in response to a motion signal exceeding a motion threshold determined by said first motion threshold device. At least one infrasonic sensing device is connected to a first infrasonic threshold device having an input connected to said infrasonic sensing device for generating an infrasonic alarm indication in response to an infrasonic signal exceeding an infrasonic threshold determined by said first infrasonic threshold device. A decision device has a motion alarm input and an infrasonic alarm input for respectively receiving said motion alarm indication and said infrasonic alarm indication, and an output, for generating a valid alarm indication upon determining simultaneity of said motion alarm indication and said infrasonic alarm indication. The arrangement may additionally include devices for receiving and sending from other alarm inputs such as smoke detectors, low temperature detectors, "panic" signals, and the like.

13 Claims, 4 Drawing Sheets

COMBINED INFRASONIC AND INFRARED INTRUSION DETECTION SYSTEM

BACKGROUND OF THE INVENTION

Field of the Invention

The invention relates to a combined infrasonic and infrared intrusion detection system, wherein outputs from an infrared motion detection system and an infrasonic detection system are combined in a logic combinational decision-making circuit for unambiguously determining presence or absence of forced entry into a defined environment.

Intrusion detection systems for areas with restricted access fall in various categories, that each have certain capabilities and drawbacks.

Of the most commonly used systems are so-called motion detectors, with which infra-red or micro-wave motion detectors are widely used. Infrared detectors are known to be reliable and are best used to operate in defined areas within "view" of the detector. Infrared motion detectors, however, have the drawback that they, when used in open or in peripheral areas, are prone to be falsely triggered by animals and moving objects, such as trees and leaves swaying in the wind and/or infra-red heat radiation from various heat sources.

Another from of intrusion detection is based on infrasonic sensing of low frequency shock waves caused by forced entry, such as breaking windows or doors. These devices are capable of providing early warnings of attempted break-in. These devices, however, have the drawback that they may be falsely triggered by external shock waves such as thunder or explosions, or the like.

SUMMARY OF THE INVENTION

It is accordingly a primary object of the invention to provide an intrusion detection system that overcomes the drawbacks of the known arrangements for intrusion detection, and provides reliable intrusion protection of defined areas without the risks of false alarms.

With the above described and other objects in view there is provided:

An intrusion and alarm sending arrangement which includes in combination:

- at least one motion sensing device, a first motion signal threshold device having an input connected to the motion sensing device for generating a motion alarm indication in response to a motion signal exceeding a motion signal threshold determined by the first motion threshold device;
- at least one infrasonic sensing device, a first infrasonic threshold device having an input connected to the infrasonic sensing device for generating an infrasonic alarm indication in response to an infrasonic signal exceeding an infrasonic threshold determined by the infrasonic threshold device; and
- a decision device having a motion alarm input and an infrasonic alarm input for respectively receiving the motion alarm indication and the infrasonic alarm indication, and an output for generating a valid alarm indication upon determining simultaneity of the motion alarm indication and the infrasonic alarm indication.

The inventive concept further includes an intrusion and alarm sending arrangement as described above, wherein further the motion sensing device includes one or more motion sensors operative for sensing at least one of a microwave signal and an infrared light signal.

The intrusion and alarm sending arrangement according to the invention may further include a radio frequency transmitter having an input connected to the motion sensing device(s) for generating a radio signal in response to a motion signal from the motion sensing device(s).

The intrusion and alarm signal according to the invention may further include a plurality of motion sensors, of which at least one has a respective radio frequency transmitter, and a radio frequency receiver, the receiver having an output for generating a motion signal in response to a radio frequency signal from at least one of the radio frequency transmitters.

The intrusion and alarm sending arrangement according the invention may additionally include a motion signal timing device having an input connected to the first motion signal threshold device, the motion signal timing device being operative for generating a time-integrated motion signal, and a second motion signal threshold device connected to the motion signal timing device being operative for generating the motion alarm indication in response to the time-integrated motion signal exceeding a second motion signal threshold.

The intrusion and alarm sending arrangement according to the invention may advantageously also include an infrasonic signal timing device having an input connected to the first infrasonic threshold device, the infrasonic signal timing device being operative for generating a time-integrated infrasonic signal, and a second infrasonic signal threshold device connected to the infrasonic signal timing device being operative for generating the infrasonic alarm indication signal in response to the time-integrated infrasonic signal exceeding a second infrasonic signal threshold.

The intrusion and alarm sending arrangement according to the invention may further include in the decision device an AND-gate having respective inputs for receiving the motion alarm indication and the infrasonic alarm indication, and an output for generating the valid alarm indication.

The intrusion and alarm indicating arrangement according to the invention may further include in the first motion threshold device a first operational amplifier having a plus input connected to the motion sensing device; a minus input; a threshold biasing diode having a cathode connected to ground potential, and an anode connected to the minus input; and wherein the first operational amplifier has an output connected to supply potential through a resistor.

In the intrusion and alarm system the first infrasonic threshold device may include a second operational amplifier having a plus input connected to the infrasonic sensing device, a minus input connected through a resistor to ground or reference potential; and a threshold biasing network having a voltage divider connected between supply potential and ground, and a dividing point connected through a forward biased diode to the minus input of the first operational amplifier.

In the intrusion and alarm sending arrangement the motion signal timing device may include a resistor and an integrating capacitor forming a parallel connection, the parallel connection having one side connected to ground, and another side connected through a forward biased diode to the output of the first operational amplifier, and similarly the infrasonic signal timing device may include a resistor and an integrating capacitor forming a parallel connection, the parallel connection having one side connected to ground and another side connected through a forward biased diode to the output of the second operational amplifier.

Other features which are considered as characteristic for the invention are set forth in the appended claims.

Although the invention is illustrated and described herein as embodied in a combined infrasonic and infrared intrusion detection system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
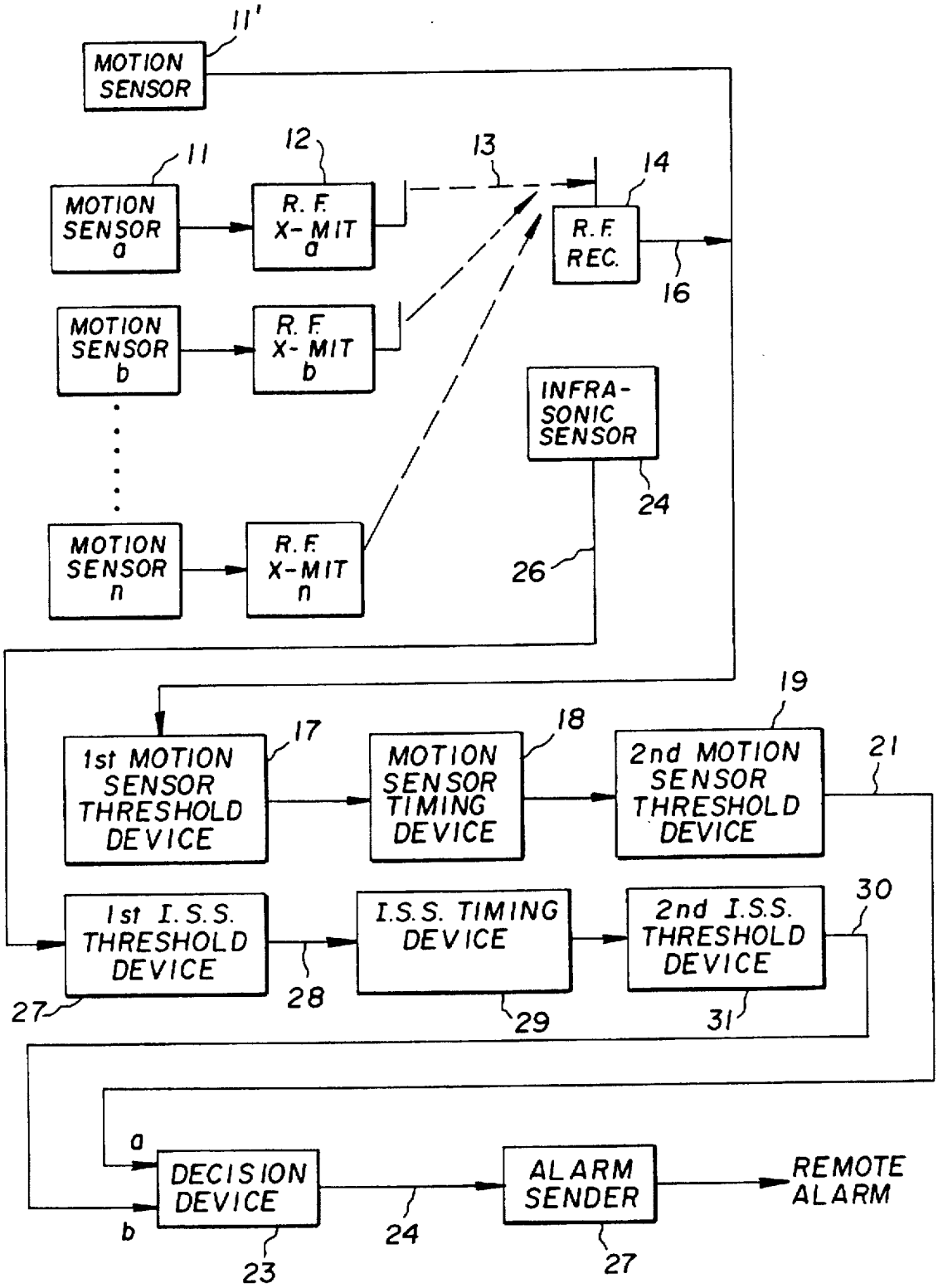
FIG. 1 is a block diagram showing the major building blocks of the intrusion and alarm sending arrangement.

In FIG. 1 motion sensors 11 (a, b . . . n), are each connected with a respective radio frequency transmitter 12 (a, b . . . n) that are each connected by radio frequency signals 13 to at least one radio frequency receiver 14, having a motion signal output 16 connected to an input of a first motion signal threshold device 17. Motion sensors are well known as based on ultra high frequency radio signals or infra red signals, which are both in principle part of the electromagnetic spectrum.

Use of radio frequency coupling between the motion sensors 11 and the first threshold device 17 is advantageous in that it avoids the cost of physical wiring, but it follows that direct coupling may be used as shown for the motion sensor 11', when such is more advantageous.

The motion signal output 16 of the radio frequency receiver 14 is connected to a first motion signal threshold device 17, which prevents minor noise signals below a given first threshold value as determined by the first motion threshold device from being registered. Still, unwanted noise signals of short duration but exceeding the first threshold value may be picked up by the motion sensors or the radio frequency transmission receiver 14. To this end a motion signal timing device 18 performs a time integration of the signals passing through the first motion signal threshold device 17. After the time integration these signals have a low signal amplitude, and are rejected in a second motion threshold device 19. As a result only valid motion alarm signals having an amplitude and duration above preset thresholds are generated at the output 21 of the second motion signal threshold device 19.

The output of the second threshold device 19 is connected via connection 21 to a first input "a" of a decision device 23.

An infrasonic sensor 24 in the form of a sound sensor or microphone, suitably adapted to be sensitive to low frequency sonic signals has an infrasonic signal output 26 connected to an input of a first infrasonic signal threshold device 27, which eliminates infrasonic signals below a set threshold value.

The output 28 of the infrasonic threshold device 27 is connected to an input of an infrasonic signal timing device 29 which time-integrates the infrasonic signals, so that false infrasonic signals of short duration that have passed the first infrasonic threshold device 27 will be integrated and rejected in a second infrasonic signal threshold device 31. Valid infrasonic signals are passed from threshold device 31 via connection 30 as valid infrasonic alarm indications to a second input b of the decision device 23. When inputs a and b are both active at the same time the decision device 23 generates a valid alarm indication at its output 24.

Figure 2:
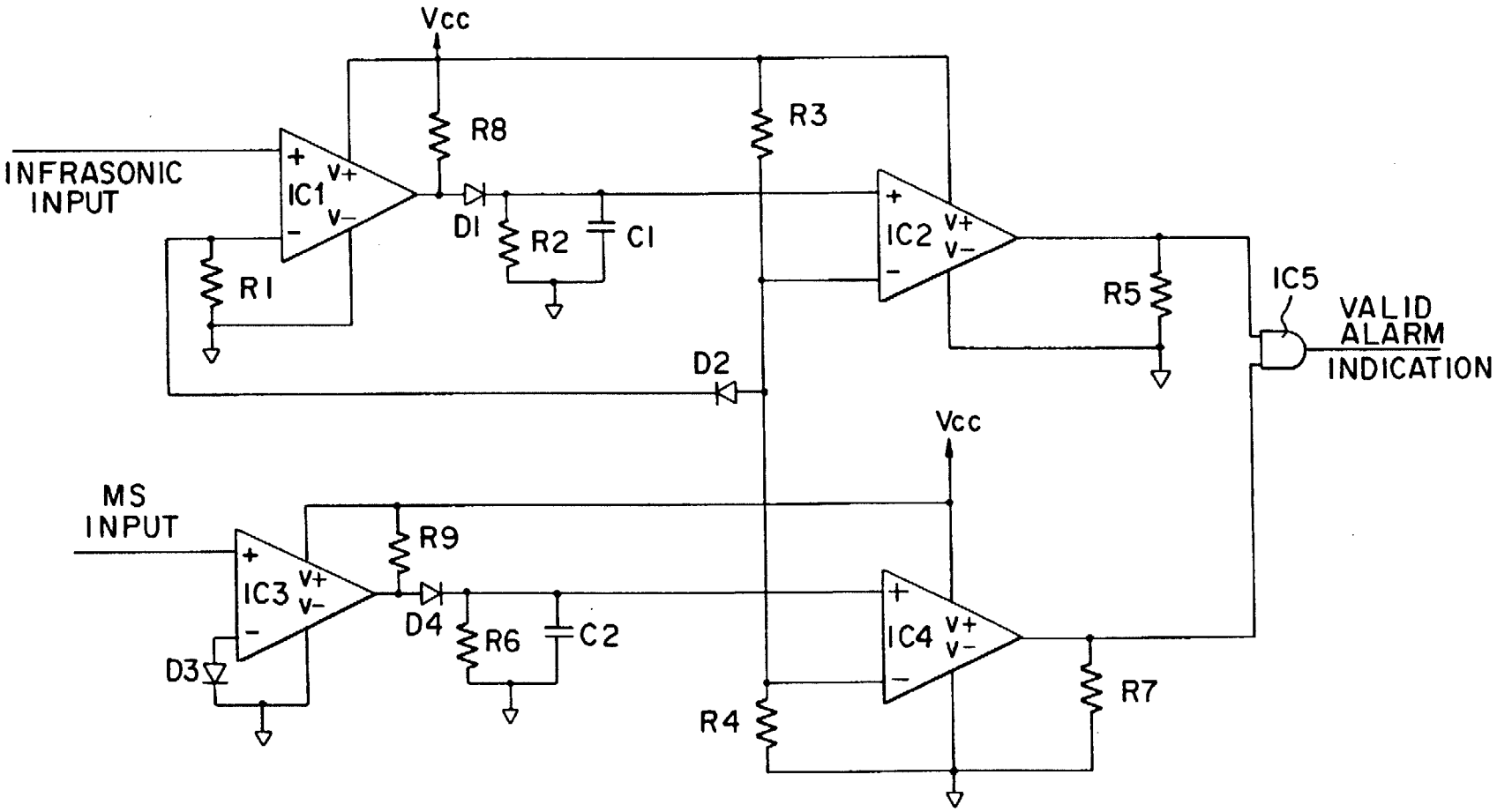
FIG. 2 is a circuit diagram showing circuit details of the intrusion and alarm sending arrangement.

FIG. 2 shows circuit details of the above-described block diagram FIG. 1 of the system, wherein an operational amplifier IC1 is arranged as a comparator. The switching level of comparator IC1 is determined by means of resistor R1 connected at one end to the minus input of comparator IC1 and at the other end to ground, or ground reference potential. The minus input of comparator IC1 is also connected to the cathode of a forward biased diode D2 having its anode connected to a voltage divider R3, R4, connected between plus supply potential VCC and ground, so that the minus input of IC1 is biased to a given positive potential, determined by resistors R1, R3, R4 and the diode D2. The output of IC1 is integrated in an integrating circuit composed of resistor R8 connected from the output of IC1 to VCC, a diode D1 having its anode connected to the output of IC1, and its cathode connected to a first common node of the parallel connection of a resistor R2 and capacitor C1, having a second common node connected to ground.

In operation the input bias potential of IC1 provides a first threshold for the infrasonic input signal. The signals passing the threshold are integrated in RC network R2, C1, and are passed on to a plus input of a second operational amplifier IC2, also operating as a threshold comparator, since its minus input is connected to the centertap of voltage divider R3, R4, as described above. Due to the integration performed by the network composed of D1, R2 and C1, only infrasonic signals of a given duration will operate to switch IC2 to produce a valid infrasonic output from IC2, as applied to resistor R5.

In other words operational amplifiers IC1 and IC2 provide a first threshold, an integration resulting in timing, and a second threshold of the infrasonic input signal.

The motion signal input MS is processed in operational amplifies IC3 and IC4, each which of again operates as a comparator. The motion signal input is connected to plus input of IC3, and the minus input is biased by the forward voltage drop of diode D3, having it cathode connected to ground.

The output of IC3 is integrated by diode D4 and resistor-capacitor network R6, C2 as described above for IC1. The second comparator IC4 is biased as IC2 by voltage divider R3, R4, and provides a second threshold for the integrated motion signal MS. The output of IC4 represents a valid motion signal.

The outputs of IC2 and IC4 are connected to a decision circuit formed as an AND gate IC5, the output of which forms a valid intrusion alarm indication.

Depending upon the configuration of an intrusion and alarm system, according to the inventive concept, it may be desirable or necessary to hold or maintain one or the other of the two alarm signals for a certain time, i.e. the infrasonic or the motion signal, before they are combined in the decision device 23. For example, if the geographic layout of the system is such that the infrasonic sensor 24 is likely to be the first one activated, and the motion sensors 11*a* . . . 11*n* are likely to be activated later, as when an intruder has first forced an entrance barrier detected by the infrasonic sensor, followed later by activation of motion sensors arranged for perimeter detection of a protected area. In such a case it would be necessary to hold the infrasonic alarm signal active for some time, until one of the motion sources is activated. Conversely, the motion sensors may be first activated, followed by later activation of the infrasonic sensor.

To that end timing devices 18, 29 are provided, as described above. The timing of the timing devices 18, 29 is a function of the time constants formed by RC networks R2, C1 and R6, C2, respectively, which are selected so as to provide adequate holding times.

In an alternate version of the invention, the signals from the motion and infrasonic sensors may be processed in a microprocessor instead of discrete circuits as described above.

Figure 3:
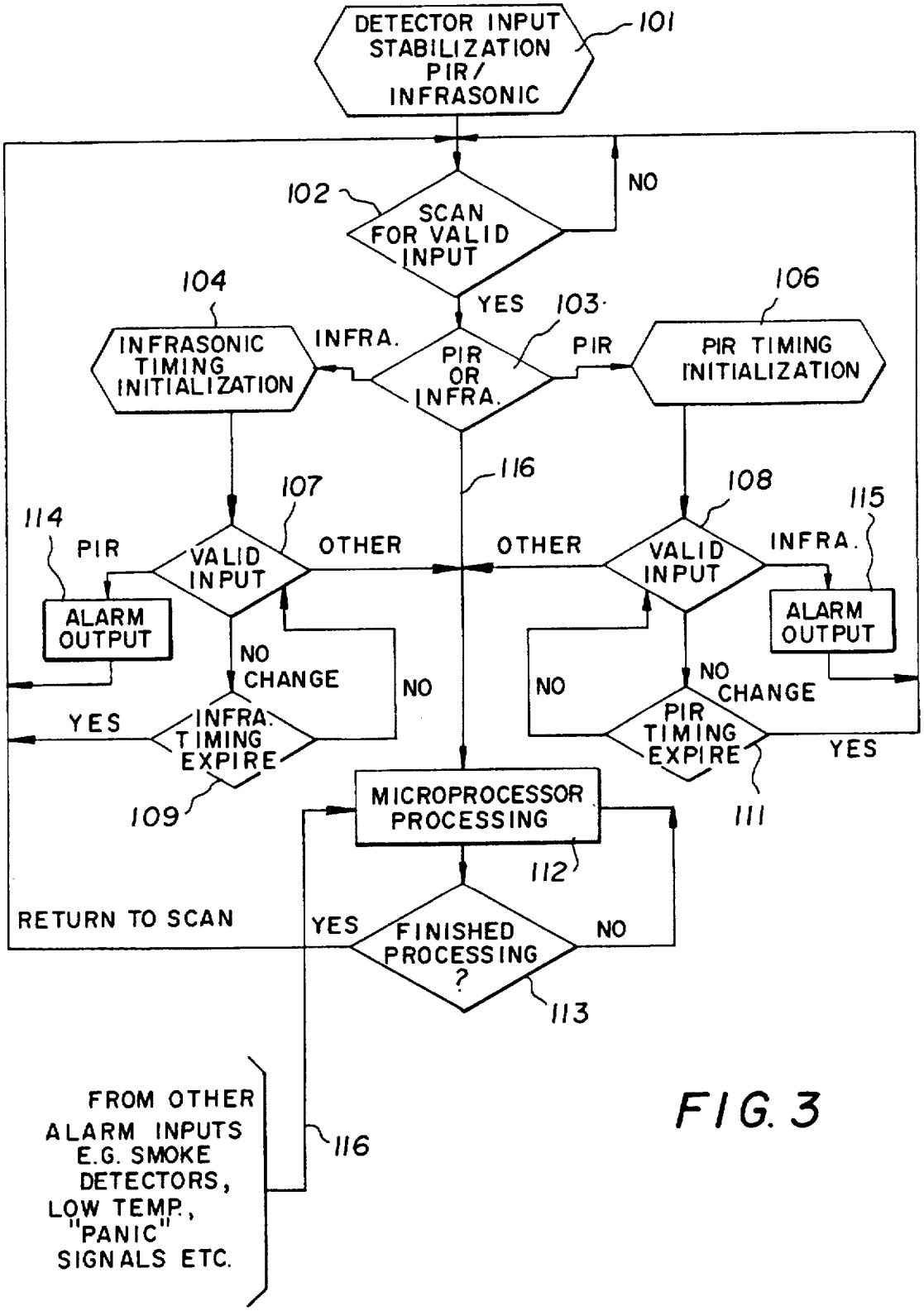
FIG. 3 is a flow chart showing the sequence of steps of the operation of the invention.

FIG. 3 shows as a flow chart or algorithm the steps to be performed in case the invention is realized by means of a microprocessor.

In step 101 the system waits for the inputs to stabilize on power-up, and scans continuously for valid input change in step 102. When a valid input occurs, processing proceeds to step 103, wherein a determination is made as to whether the input is from (a) an infrasonic device, (b) a motion sensing device, or (c) another system device, i.e. smoke detectors, "panic" buttons, low temperature sensors, etc.

In the case of a valid infrasonic detector signal, processing proceeds to step 104, wherein a timing cycle is initiated. After initiating the infrasonic timing cycle, processing proceeds to step 107 wherein the inputs are again scanned for a valid change. It should be noted that the inputs may include infrasonic, motion, and other inputs from various devices such as alarm inputs, smoke detectors, low-temperature sensors, "panic" signals, etc. The scan for an input change is coupled with a loop incorporating step 109, wherein a check is made to see if the infrasonic timing cycle has expired. If no valid change in inputs occur before the expiration of the infrasonic timing cycle, processing reverts back to step 102, wherein the process is re-initiated.

However, if a valid change change occurs at step 107 before the infrasonic timing expires, and the input change indicates a motion sensor input, it is confirmed that the condition of both signals, infrasonic and motion, are present at the same time, and accordingly an alarm condition output is generated. In case the input change that occurred at step 107 were from another system component, processing would proceed to steps 112 and 113, wherein other system functions are processed.

In the case of a valid motion detector signal, processing proceeds to step 106, wherein a motion timing cycle is initiated. After initiating the motion timing cycle, processing proceeds to step 108, wherein the inputs are again scanned for a valid change. The scan for an input change is coupled with a loop incorporating step 111, which provides a check to see if the motion timing cycle has expired. If no valid change in inputs occur before expiration of the motion timing cycle, processing reverts back to step 102, wherein the whole process is re-initiated.

However, if a valid input change does occur at step 108 before the motion timing cycle expires, and the input change indicates an infrasonic sensor input, the condition of both signals infrasonic and motion being present at the same time is satisfied, and accordingly an alarm condition is generated. In the case wherein the input changes in step 108 were from another system component, processing would proceed to steps 112 and 113, in which manner other system functions and other alarm inputs from 116 are processed.

In the case that a valid input change appears at step 102 from another system component, processing proceeds to steps 112 and 113 wherein other system processing is performed, and then a return is made to step 102 for continued operation.

In the second case the invention, as illustrated in FIG. 3 accomplishes the objectives previously described, by using an algorithm that models the naturally occurring sequence of events resulting from a forced entry. The microprocessor monitors inputs coming from the radio frequency receiver and the infrasonic sensing device. The microprocessor buffers the inputs and continues to process according to the flowchart of FIG. 3.

Figure 4:
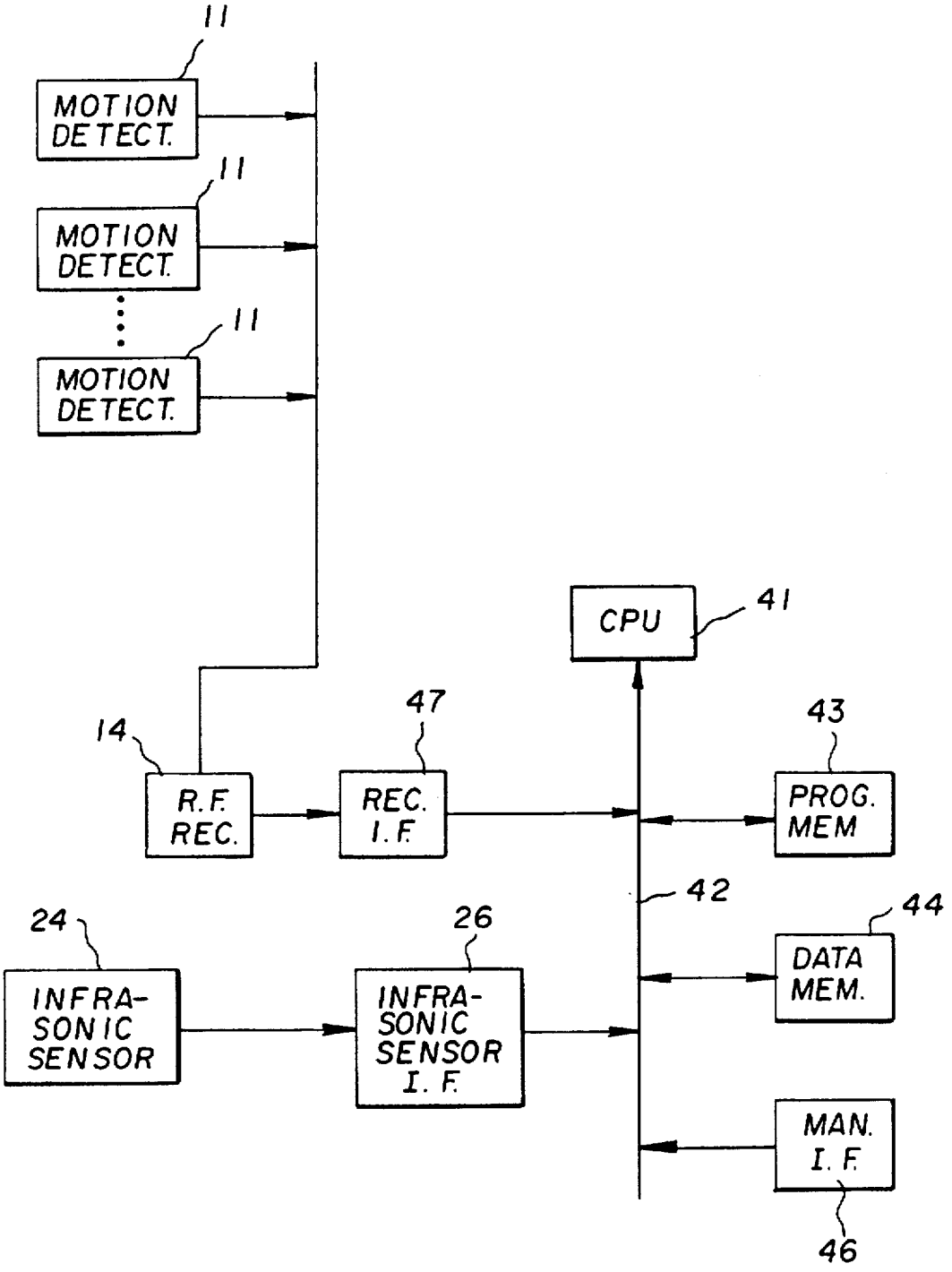
FIG. 4 shows a block diagram of part of the invention, wherein a microprocessor operates as the decision device.

FIG. 4 is a block diagram of a microprocessor arrangement, wherein a central processing unit CPU 41 is connected to a common data bus 42. A program memory 43, and a data memory 44 are connected to the CPU bus 42. A manual interface 46 serves to customize and initialize the system. The radio frequency receiver 14 is similar to the receiver 14 in FIG. 1 and is connected via a receiver interface 47 to the data bus 42. One or several infrasonic sensors 24 is/are connected via an infrasonic interface 26 to the data bus 42. signals on the data bus 42 are processed by the CPU in accordance with control programs and data stored in memories 43, 44.

An exemplary detailed listing of the code of the algorithm of FIG. 3 is shown in the following pages **15*a*–15*h***.

I claim:

1. An intrusion and alarm sending arrangement comprising:

at least one motion sensing device, a first motion signal threshold device having an input connected to said motion sensing device for generating a motion alarm indication in response to a motion signal exceeding a motion threshold determined by said first motion threshold device;

at least one infrasonic sensing device, an infrasonic threshold device having an input connected to said infrasonic sensing device for generating an infrasonic alarm indication in response to an infrasonic signal exceeding an infrasonic threshold determined by said infrasonic threshold device;

a decision device having a motion alarm input and an infrasonic alarm input for respectively receiving said motion alarm indication and said infrasonic alarm indication, and an output for generating a valid alarm indication upon determining simultaneity of said motion alarm indication and said infrasonic alarm indication and a motion signal timing device having an input connected to said first motion signal threshold device, said motion signal timing device being operative for generating a time-integrated motion signal, and a second motion signal threshold device connected to said motion signal timing device operative for generating said motion alarm indication in response to said time-integrated motion signal's exceeding a second motion signal threshold.

2. An intrusion and alarm sending arrangement according to claim 1, wherein said at least one motion sensing device includes at least one motion sensor operative for sensing at least one of a microwave signal and an infrared light signal.

3. An intrusion and alarm sending arrangement according to claim 1, including a radio frequency transmitter having an input connected to at least one associated motion sensing device for generating a radio signal in response to a motion signal from any said associated motion sensing device.

4. An intrusion and alarm sending arrangement according to claim 3, including a radio frequency receiver having an output for generating a motion signal in response to a radio frequency signal from said radio frequency transmitter.

5. An intrusion and alarm sending arrangement according to claim 1, wherein said decision device includes an AND-gate having respective inputs for receiving said motion alarm indication and said infrasonic alarm indication, and an output for generating said valid alarm indication.

6. An intrusion and alarm indicating arrangement according to claim 1, wherein said first motion signal threshold device includes an operational amplifier having a plus input connected to said motion sensing device; a minus input; a threshold biasing diode having a cathode connected to ground potential, and an anode connected to said minus input; and wherein said operational amplifier has an output connected to supply potential through a resistor.

7. An intrusion and alarm sending arrangement according to claim 6, wherein said motion signal timing device includes a resistor and an integrating capacitor forming a parallel connection, the parallel connection having one side connected to ground, and another side connected through a forward biased diode to said output of said operational amplifier.

8. An intrusion and alarm sending arrangement according to claim 1, including a holding device operative for receiving and holding at least one of said motion signal and infrasonic signal for a given length of time.

9. An intrusion and alarm sending device according to claim 1, wherein said decision device includes a microprocessor having respective inputs for receiving said motion and said infrasonic signal.

10. An intrusion and alarm sending device, according to claim 9, wherein said microprocessor includes a central processing unit.

11. An intrusion and alarm sending arrangement comprising:

at least one motion sensing device, a motion signal threshold device having an input connected to said motion sensing device for generating a motion alarm indication in response to a motion signal exceeding a motion threshold determined by said motion signal threshold device;

at least one infrasonic sensing device, a first infrasonic signal threshold device having an input connected to said infrasonic sensing device for generating an infrasonic alarm indication in response to an infrasonic signal exceeding an infrasonic threshold determined by said first infrasonic threshold device;

a decision device having a motion alarm input and an infrasonic alarm input for respectively receiving said motion alarm indication and said infrasonic alarm indication, and an output, for generating a valid alarm indication upon determining simultaneity of said motion alarm indication and said infrasonic alarm indication; and an infrasonic signal timing device having an input connected to said first infrasonic signal threshold device, said infrasonic signal timing device being operative for generating a time-integrated infrasonic signal, and a second infrasonic signal threshold device connected to said infrasonic signal timing device being operative for generating said infrasonic alarm indication in response to said time-integrated infrasonic signal's exceeding a second infrasonic signal threshold.

12. An intrusion and alarm system according to claim 11, wherein said first infrasonic signal threshold device includes an operational amplifier having a plus input connected to said infrasonic sensing device, a minus input connected to ground potential through a resistor; and a threshold biasing network having a voltage divider connected between supply potential and ground, and a dividing point connected through a forward biased diode to said minus input.

13. An intrusion and alarm sending arrangement according to claim 11, wherein said infrasonic signal timing device includes a resistor and an integrating capacitor forming a parallel connection, the parallel connection having one side connected to ground and another side connected through a forward biased diode to said output of said further operational amplifier.

* * * * *